US007520036B1

(12) United States Patent
Baldwin et al.

(10) Patent No.: US 7,520,036 B1
(45) Date of Patent: Apr. 21, 2009

(54) MULTI-POINT BUCKLE FOR RESTRAINT SYSTEM

(75) Inventors: Jeffrey Philip Baldwin, Phoenix, AZ (US); Agus Suryana The, Mesa, AZ (US)

(73) Assignee: AmSafe Commercial Products, Inc., Elkhart (IN)

( * ) Notice: Subject to any disclaimer, the term of this patent is extended or adjusted under 35 U.S.C. 154(b) by 599 days.

(21) Appl. No.: 10/816,013

(22) Filed: Apr. 1, 2004

Related U.S. Application Data

(60) Provisional application No. 60/486,631, filed on Jul. 11, 2003.

(51) Int. Cl.
*A44B 21/00* (2006.01)

(52) U.S. Cl. ..... 24/635; 70/70; 24/650; 24/641; 24/645; 24/648; 24/642

(58) Field of Classification Search ..... None
See application file for complete search history.

(56) References Cited

U.S. PATENT DOCUMENTS 486,227 A * 11/1892 Henry ..... 70/70
2,970,796 A 2/1961 Ross (Continued)

FOREIGN PATENT DOCUMENTS

DE 4421688 C1 12/1995

(Continued)

OTHER PUBLICATIONS

US 4,945,615, 08/1990, Anthony et al. (withdrawn)

*Primary Examiner*—Jack W. Lavinder
(74) *Attorney, Agent, or Firm*—Perkins Coie LLP

(57) ABSTRACT

The present invention provides a buckle and tongue combination for restraining an occupant in a seat, the buckle and tongue combination. The combination includes a housing, a frame located within the housing, two pawls disposed upon the frame, each pawl having a distal end and a proximal end, each distal end having a release abutment extending from the respective pawl, a hinge pin disposed at the proximal end of each pawl for pivotally coupling the pawls to the frame, a tongue adapted to be disposed adjacent the two pawls, the tongue interlockingly engages the pawls, a biasing member disposed within the housing, the biasing member engages the pawls urging the pawls to a locked position with respect to the adjacent tongue and a release button slidably secured along the frame, the release button biased in a first or locked position, the release button having at least one inclined abutment surface which engages the release abutments and urges the two pawls towards an unlocked position when the release button is urged toward a second position opposite from the first position, whereby the user is able to release the tongue from the buckle upon depressing the release button toward the second or unlocked position.

In one embodiment, the tongues include a molded portion and an alignment key so as to assure proper orientation of the tongue with the housing. In addition, the housing includes an ejector contact pad which acts against the alignment key to eject the tongues. The contact pad is finished so as to provide an aesthetic appearance. In another embodiment, the tongue may comprise a single tongue rather than dual tongues. Still further, another embodiment provides overlapping tongues wherein a first tongue includes a pawl spreader and a second tongue includes a pawl lock.

24 Claims, 11 Drawing Sheets

U.S. PATENT DOCUMENTS

| | | | | |
|---|---|---|---|---|
| 3,262,169 | A | | 7/1966 | Jantzen |
| 3,523,342 | A | | 8/1970 | Spires |
| 3,605,207 | A | | 9/1971 | Glauser et al. |
| 3,605,210 | A | | 9/1971 | Lohr |
| 3,631,571 | A | | 1/1972 | Stoffel |
| 3,644,967 | A | | 2/1972 | Romanzi, Jr. et al. |
| 3,648,333 | A | | 3/1972 | Stoffel |
| 3,825,979 | A | | 7/1974 | Jakob |
| 3,935,618 | A | | 2/1976 | Fohl |
| 3,986,234 | A | | 10/1976 | Frost et al. |
| 4,100,657 | A | | 7/1978 | Minolla |
| 4,181,832 | A | | 1/1980 | Ueda |
| 4,228,567 | A | | 10/1980 | Ikesue et al. |
| 4,262,396 | A | | 4/1981 | Koike |
| 4,317,263 | A | | 3/1982 | Fohl |
| 4,321,734 | A | | 3/1982 | Gandelman |
| 4,334,341 | A | | 6/1982 | Krautz et al. |
| 4,408,374 | A | | 10/1983 | Fohl |
| 4,457,052 | A | | 7/1984 | Hauber |
| 4,545,097 | A | | 10/1985 | Wier |
| 4,637,102 | A | | 1/1987 | Teder et al. |
| 4,638,533 | A | | 1/1987 | Gloomis et al. |
| 4,644,618 | A | | 2/1987 | Holmberg et al. |
| 4,646,400 | A | | 3/1987 | Tanaka |
| 4,711,003 | A | | 12/1987 | Gelula |
| 4,757,579 | A | | 7/1988 | Nishino et al. |
| 4,809,409 | A | | 3/1989 | Van Riesen |
| 5,008,989 | A | * | 4/1991 | Wedler et al. ..... 24/641 |
| 5,023,981 | A | | 6/1991 | Anthony et al. |
| 5,038,446 | A | | 8/1991 | Anthony et al. |
| 5,067,212 | A | | 11/1991 | Ellis |
| 5,088,163 | A | | 2/1992 | Van Riesen |
| 5,119,532 | A | | 6/1992 | Tanaka |
| 5,159,732 | A | | 11/1992 | Burke |
| 5,267,377 | A | | 12/1993 | Gillis et al. |
| 5,269,051 | A | | 12/1993 | McFalls |
| 5,283,933 | A | | 2/1994 | Wiseman et al. |
| 5,406,681 | A | | 4/1995 | Olson |
| 5,526,556 | A | | 6/1996 | Czank |
| 5,561,891 | A | | 10/1996 | Hsieh |
| 5,588,189 | A | | 12/1996 | Gorman et al. |
| 5,606,783 | A | | 3/1997 | Gillis et al. |
| 5,699,594 | A | | 12/1997 | Czank et al. |
| 5,813,097 | A | | 9/1998 | Woellert et al. |
| 5,908,223 | A | | 6/1999 | Miller |
| 6,363,591 | B1 | | 4/2002 | Bell et al. |
| 6,619,753 | B2 | | 9/2003 | Takayama |
| 2003/0056346 | A1 | | 3/2003 | Perrero |

FOREIGN PATENT DOCUMENTS

| | | |
|---|---|---|
| EP | 0608564 B1 | 3/1999 |
| WO | WO 86/03386 | 6/1986 |

* cited by examiner

MULTI-POINT BUCKLE FOR RESTRAINT SYSTEM

CROSS-REFERENCE TO RELATED APPLICATION

This application claims the benefit of U.S. Provisional Application No. 60/486,631, filed Jul. 11, 2003.

FIELD OF THE INVENTION

The invention relates generally to safety restraints systems and, in particular, buckle and tongue combinations for safety restraints in vehicle child seats.

BACKGROUND OF THE INVENTION

The prior art safety restraint systems include combination buckle and tongue devices incorporated in a belt or webbing system to safely secure an individual or occupant in a seat. The buckle supplies the necessary attachment portions so that a five-point or three-point restraint can be used. The terms "three-point" and "five-point" refer to the number of anchorage points built into the restraint system. For example, in a five-point restraint, anchorage points are located as follows: one for each shoulder, one in front of the crotch, and one on each side of the hips. Webbing is placed through eyelet holes at each seat anchorage point and through the three web slots on the buckle device.

U.S. Pat. No. 3,262,169 discloses a buckle assembly having a single tongue with dual pawls. The pawls are released via a cover lever which pivots about hinge point so that a driving portion engages actuating arms to pivot locking dogs out of engagement with the tongue. U.S. Pat. No. 4,809,409 discloses a belt lock for safety belt systems having split or dual tongues with side notches. U.S. Pat. No. 6,619,753 discloses a car seat having a buckle in a five point restraint system.

The prior art systems suffer disadvantages. For instances, the prior art can be cumbersome to use, and lack a positive lock acknowledgement. The prior art systems are expensive to manufacture and are bulky.

SUMMARY OF THE INVENTION

The present invention provides a buckle and tongue combination for restraining an occupant in a seat, the buckle and tongue combination. The combination includes a housing, a frame located within the housing, two pawls disposed upon the frame, each pawl having a distal end and a proximal end, each distal end having a release abutment extending from the respective pawl, a hinge pin disposed at the proximal end of each pawl for pivotally coupling the pawls to the frame, a tongue adapted to be disposed adjacent the two pawls, the tongue interlockingly engages the pawls, a biasing member disposed within the housing, the biasing member engages the pawls urging the pawls to a locked position with respect to the adjacent tongue and a release button slidably secured along the frame, the release button biased in a first or locked position, the release button having at least one inclined abutment surface which engages the release abutments and urges the two pawls towards an unlocked position when the release button is urged toward a second position opposite from the first position, whereby the user is able to release the tongue from the buckle upon depressing the release button toward the second or unlocked position.

In one embodiment, the tongues include a molded portion and an alignment key so as to assure proper orientation of the tongue with the housing. In addition, the housing includes an ejector contact pad which acts against the alignment key to eject the tongues. The contact pad is finished so as to provide an aesthetic appearance. In another embodiment, the tongue may comprise a single tongue rather than dual tongues. Still further, another embodiment provides overlapping tongues wherein a first tongue includes a pawl spreader and a second tongue includes a pawl lock.

DETAILED DESCRIPTION OF THE INVENTION

Figure 1:
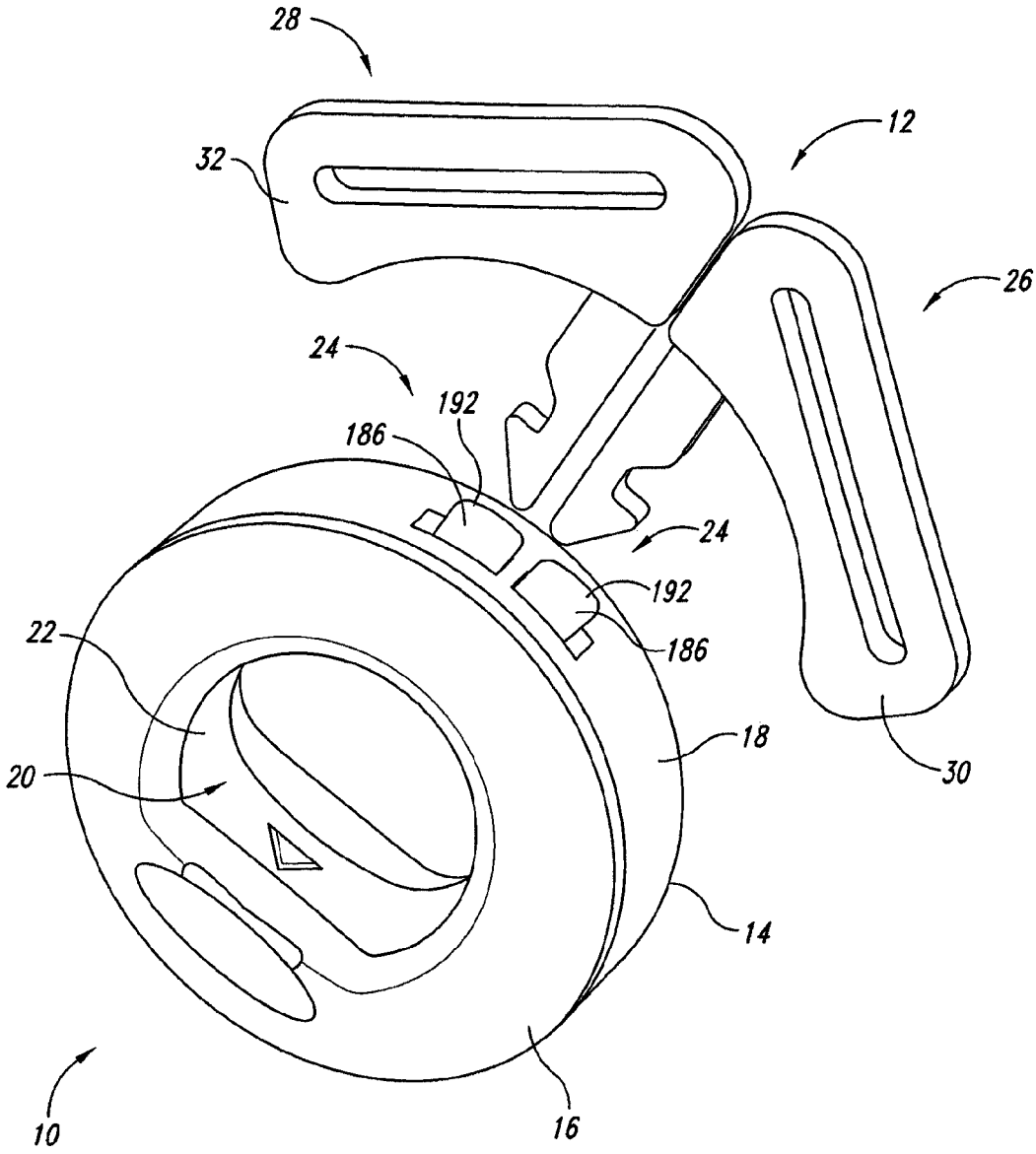
FIG. 1 is a perspective view of a buckle and dual tongue combination in accordance with the present invention.

FIG. 1 shows a perspective view of a buckle 10 and dual tongue 12 combination in accordance with a preferred embodiment in the present invention. The buckle 10 is shown to include a housing 14 having a front housing portion 16 and a back housing portion 18. An opening 20 is provided in the front housing portion 16 and allows access to a release button 22. The top of the housing includes tongue openings 24 which receive the respective first and second tongues 26, 28. Each tongue 26, 28 includes a molded belt slot portion 30, 32.

Figure 2:
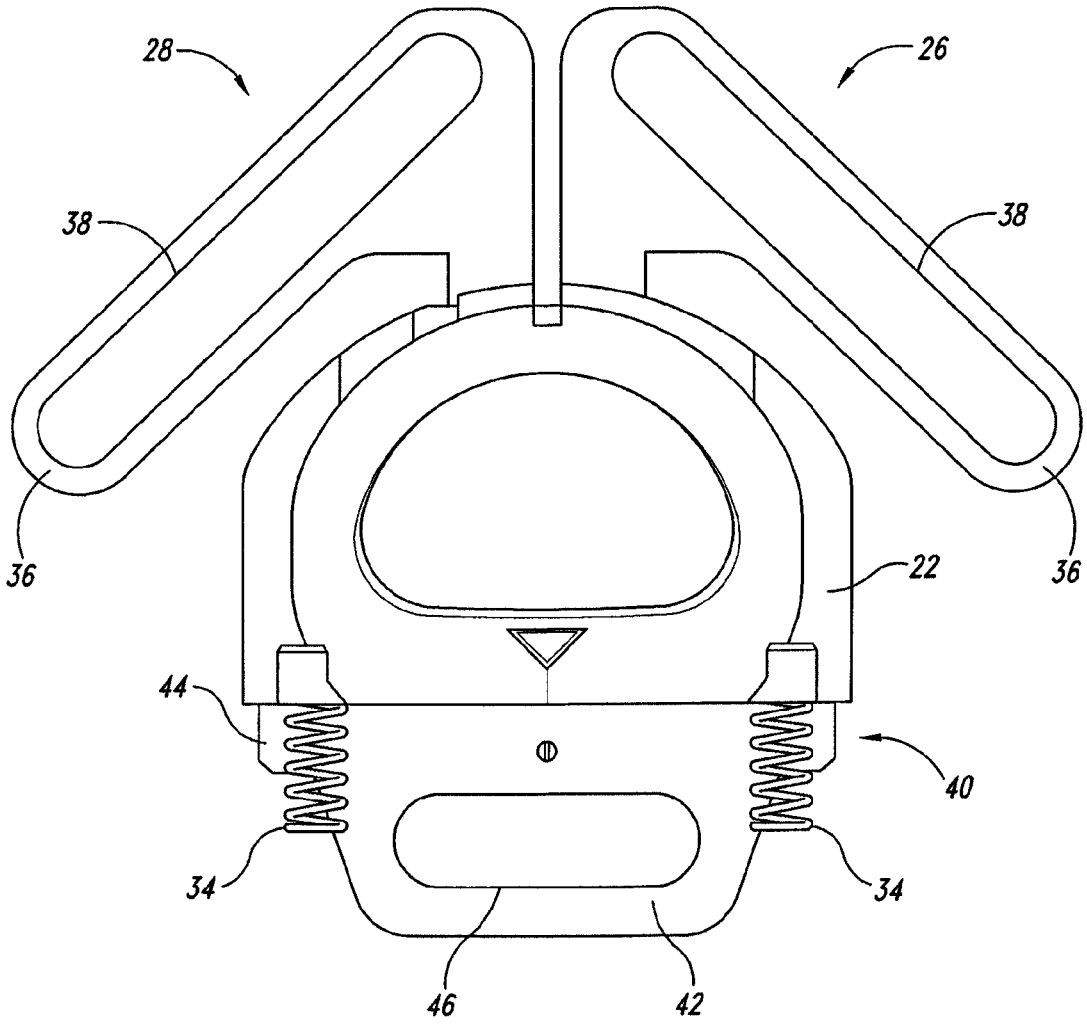
FIG. 2 is a partial view of the buckle and dual tongue of FIG. 1.

FIG. 2 is a partial view of the buckle 10 and dual tongue 12 shown in FIG. 1. However, the molded belt slot portions 30, 32 have been omitted for sake of illustration, as well as the housing 14. FIG. 2 better illustrates the release button 22, and also shows the release button springs 34. With the molded belt slot portion 30,32 omitted, FIG. 2 readily shows the depending portion 36 extending from the respective tongue 26, 28. The depending portion 36 includes the belt slot 38. A belt (not shown) extending from a chest harness (not shown) may extend through the belt slot 38 of the depending portion 36 of the tongues 26, 28. A portion of a frame 40 is also shown including the front frame half 42. The back frame half 44 can be seen in FIG. 3. The frame 40 includes a belt slot 46 for receiving webbing or other type of belt (not shown) so as to provide a crotch anchoring of the buckle 10.

Figure 3:
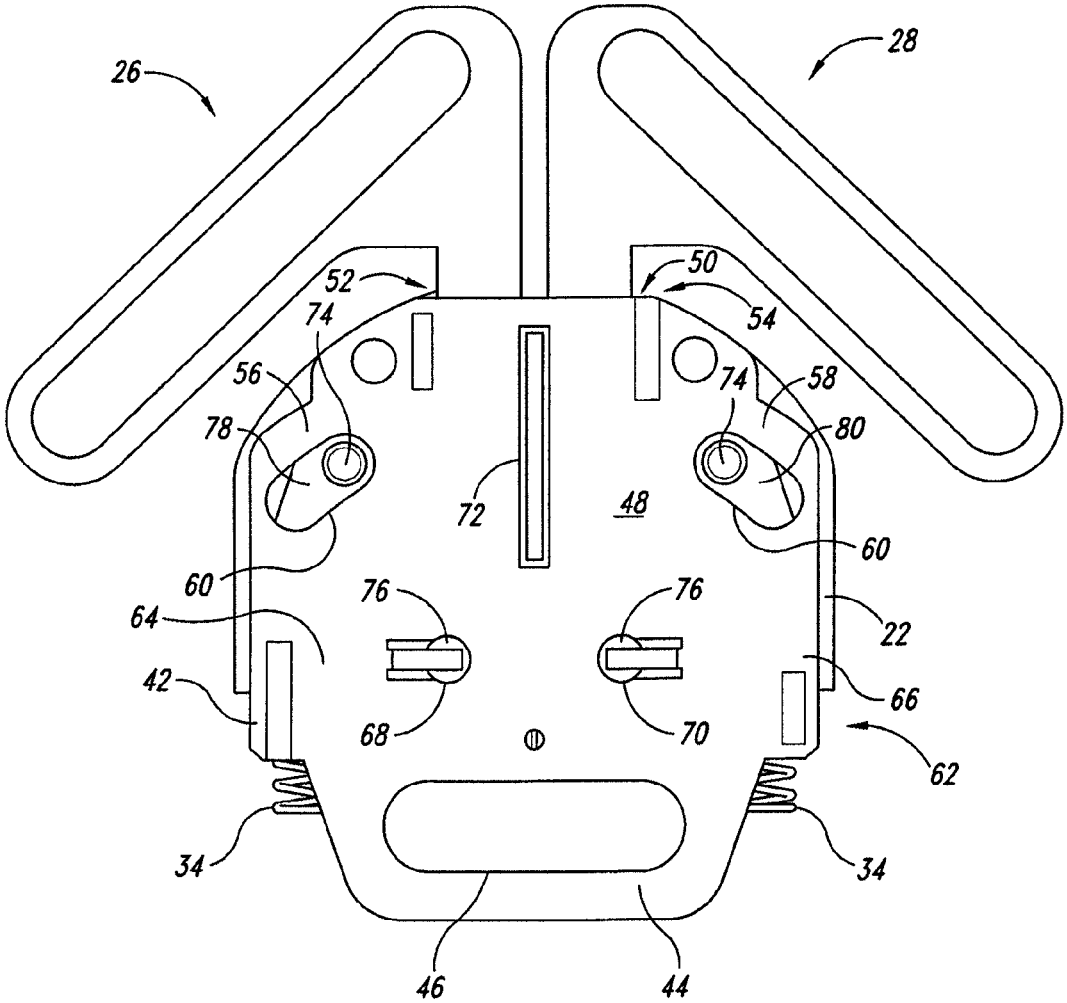
FIG. 3 is a back view of the buckle and dual tongue combination shown in FIG. 2.

FIG. 3 is a partial back view of the buckle 10 and dual tongue 12 combination shown in FIG. 2. The back frame half 44 is clearly shown, as well as a portion of the front frame half 42. The front and back frame halves 42, 44 are identical components. Each frame half 42, 44 includes a substantially planar or main body portion 48 having a tongue receiving neck portion 50 with a left side 52 and a right side 54. The main body portion 48 also includes a left shoulder portion 56 and right shoulder portion 58, with each shoulder portion having an arcuate shaped pawl release pin slot 60. A lower portion 62 of the main body portion 48 includes a left side 64 and a right side 66. The lower portion 62 includes a left and right pawl hinge pin recess 68, 70. The neck portion 50 also includes a separator slot 72 extending longitudinally along a center line of the neck portion 50. A pawl release pin 74 is shown to be received by each arcuate shaped pawl release pin slot 60. A hinge pin 76 is shown to be received by each hinge pin recess 68, 70.

Figure 4:
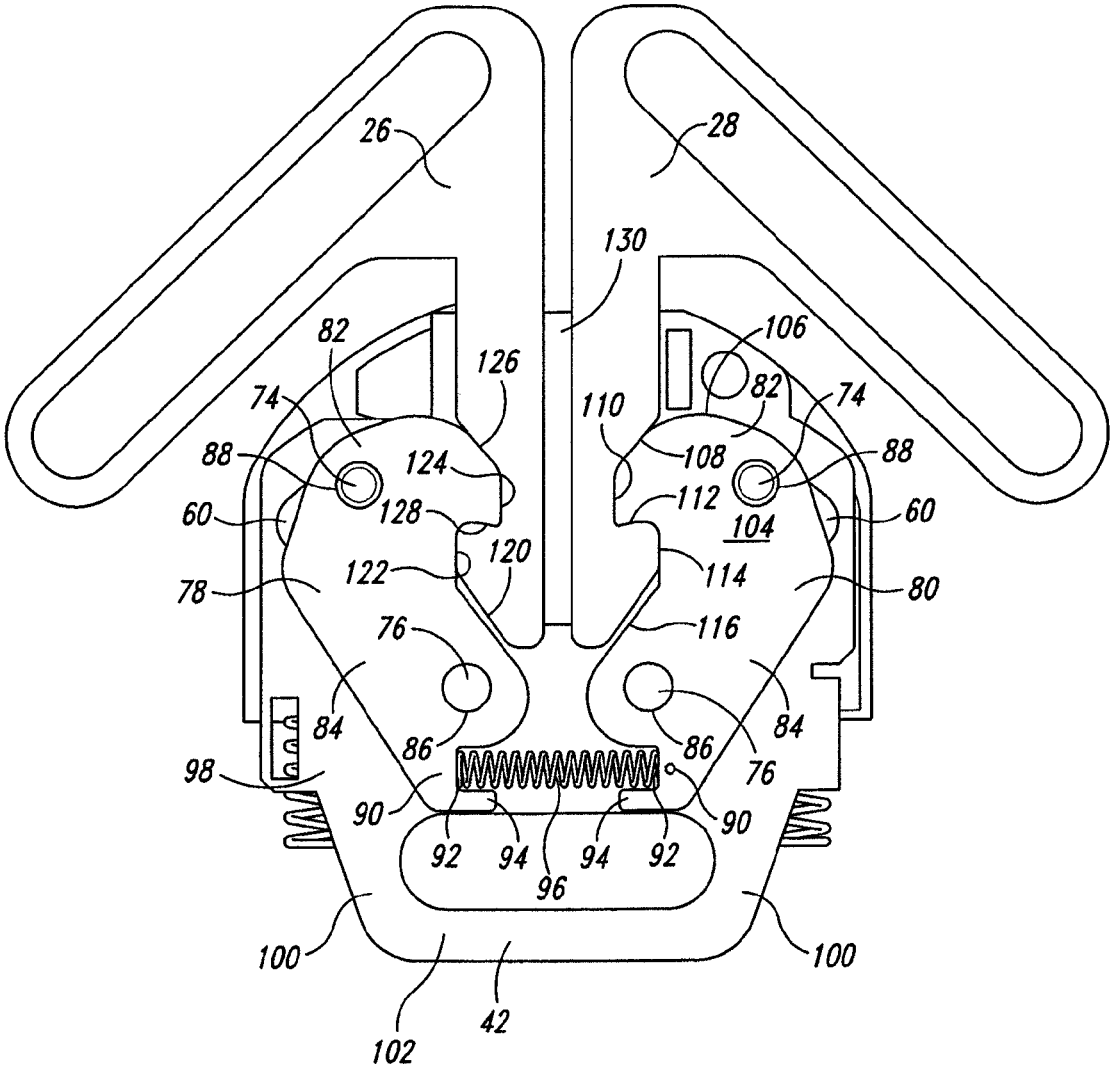
FIG. 4 is a view of the buckle and dual tongue combination of FIG. 3, but with the back frame half omitted.

FIG. 4 is a partial view of the buckle 10 and dual tongue 12 combination of FIG. 3, but with the back frame half 44 omitted and exposing the front frame half 42. Most apparent in FIG. 4 is the left and right pawls 78, 80. Each pawl 78, 80 includes a distal end 82 and a proximal end 84. Each proximal end 84 includes a hole 86 to receive and retain a hinge pin 76. The distal ends 82 each include a hole 88 to receive and retain a pawl release pin 74. The proximal end 84 of the pawls 78, 80 also include a spring retainer 90 which includes a recessed area 92 formed by an over hanging flange portion 94. A pawl spring 96 is trapped between the spring retainer 90 and the opposing inner walls 98 of the frame halves 42, 44. A coil spring is shown but other embodiments are possible such as a bent metal plate spring. A bend portion 100 is shown in the front frame half 42 which offsets the plane of a belt slot portion 102 inwardly from the plane of the main body portion 48 of the frame 40. In this manner, the opposing belt slot portions 102 from each frame half 42, 44 come into facing contact with one another and the main body portions 48 are thus spaced apart to accommodate the pawls 78, 80.

Each pawl 78, 80 includes a hook portion 104 which is formed by a curved portion 106 having a pawl spreading engagement wall 108 which in the locked position of FIG. 4 extends at a substantially 45 degree angle with respect to the longitudinal axis of the respective tongue 26, 28. The pawl spreading engagement wall 108 extends into a first longitudinally extending wall 110. A pawl ledge 112 is located between the first longitudinally extending wall 110 and a second longitudinally extending wall 114. Each pawl 78, 80 further includes an abutment wall 116. FIG. 4 shows that the pawl ledges 112 have a mild reverse angle such that the pawl ledges 112 extend in a converging manner in a direction downward as viewed from FIG. 4.

Each of the tongues 26, 28 of FIG. 4 are shown to include a pawl spreader wall 120, a first and second longitudinally extending wall 122, 124, an abutment wall 126, and a tongue ledge 128. The tongue ledge 128 extends in an angle, as viewed in FIG. 4, in a manner similar to the pawl ledges 112. A longitudinally extending separator plate 130 is shown to be located between the dual tongues 26, 28.

Figure 5:
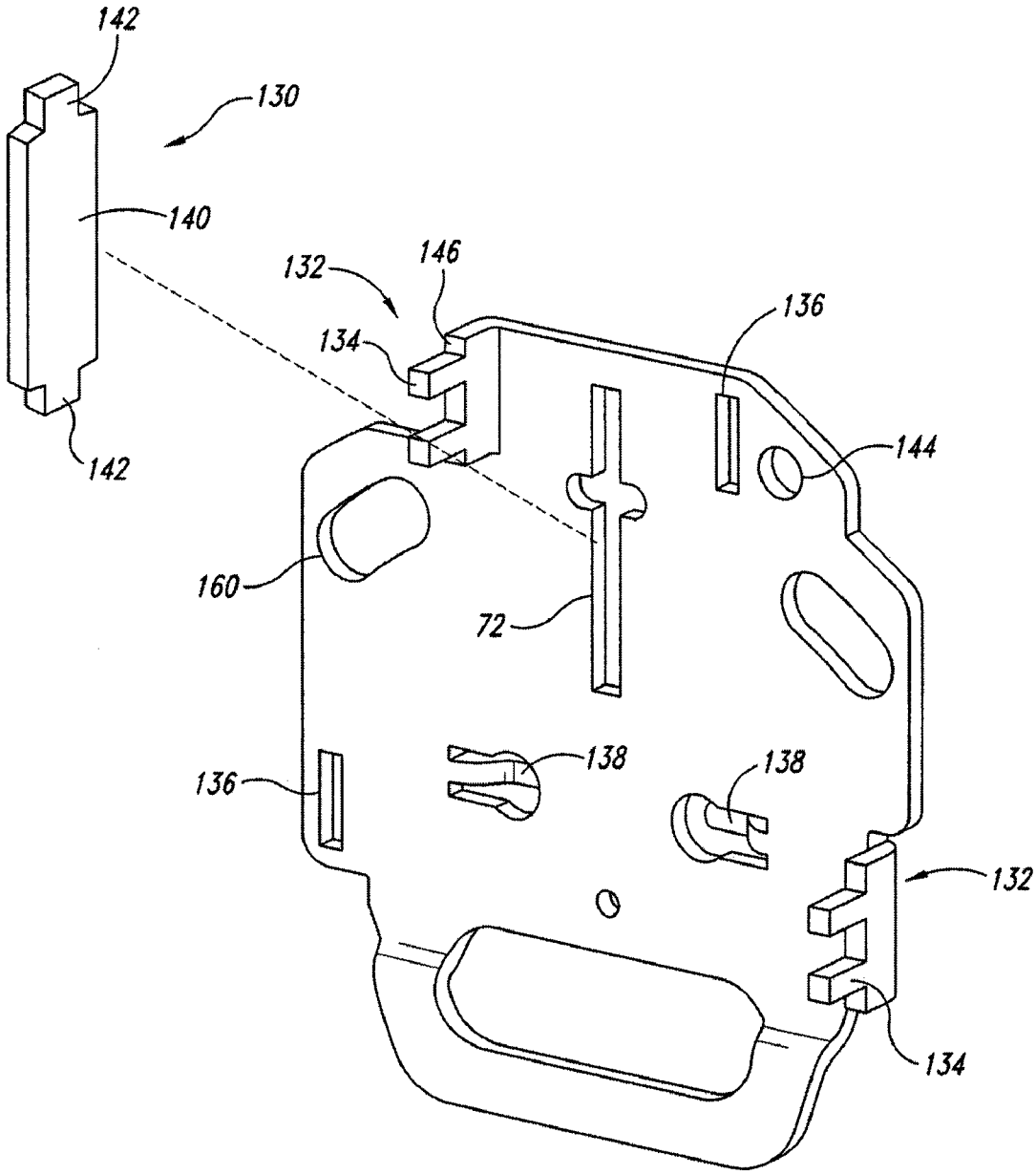
FIG. 5 is a partial perspective, partial exploded view of one frame half and a separator.

FIG. 5 is a perspective exploded view of one of the frame halves 42, 44 and the separator plate 130. As noted above, the first and second frame halves 42, 44 are identical. One of the sides of the neck portion 50 includes a flange portion 132 extending from the main body portion 48 at a right angle and in a plane parallel to a tongue path. The flange portion 132 includes two tabs 134 extending outwardly from the flange portion 132. The other side of the neck portion 50 includes a slot 136 adapted to receive the neck flange portion 132 from the mating frame half. The lower portion 62 of the main body portion 48 includes a flange portion 132 extending from the main body portion 48 at a right angle and in a plane parallel to a tongue path. The flange portion 132 also includes two tabs 134 extending from the flange portion 132. The other side of the lower portion 62 includes a slot 136 for receiving a flange portion 132 from a mating frame half 42, 44. The pawl hinge pin recesses 68, 70 are shown to be formed by a deformed tab 138 displaced from a plane of the main body portion 48. The longitudinal separator slot 72 is shown to extend along a center line of the neck portion 50. The separator plate 130 is shown to include a main body portion 140 with tabs 142 extending from both ends. The separator plate 130 is received by the separator slot 72 and is prevented from passing through the slot 72 by means of the end tabs 142. The separator plate 130 is necessary for the dual tongue embodiment of FIG. 4 because it counters the force applied by each pawl. Without the plate 130, the two pawls would squeeze the tongue slightly but the tongue would still be free to wiggle in the neck portion and possible escape from the buckle prematurely. The frame 40 further includes a hole 144 for securing the frame 40 to the housing 14.

It will be appreciated that when the first and second frame halves 42,44 are assembled, the flange portion 132 extending from the neck portion 50 of one frame half is received by the slot 136 formed in the neck portion of the other frame half. Therefore, the tabs 134 of the flange portion 132 may be deformed or displaced so as to prevent the flange portion 132 from being withdrawn from the respective slot 136. In a similar manner, the lower flange portions 132 are received and secured by the respective lower slot 136 of the mating frame half. The flange portions 132 include a shoulder 146 having a width wider than the width of the slots 136. The shoulder 146 therefore engages the inner wall of the mating frame half in an abutting manner and defines, together the mating belt slot portions 30, 32, the dimensions of the interior space or compartment between the frame halves 42, 44. The frame may also include holes for restraint of the various springs disclosed herein. Alternatively to that disclosed herein, the pawl, release pin and hinge pin may be a unitary cast metal.

Figure 6:
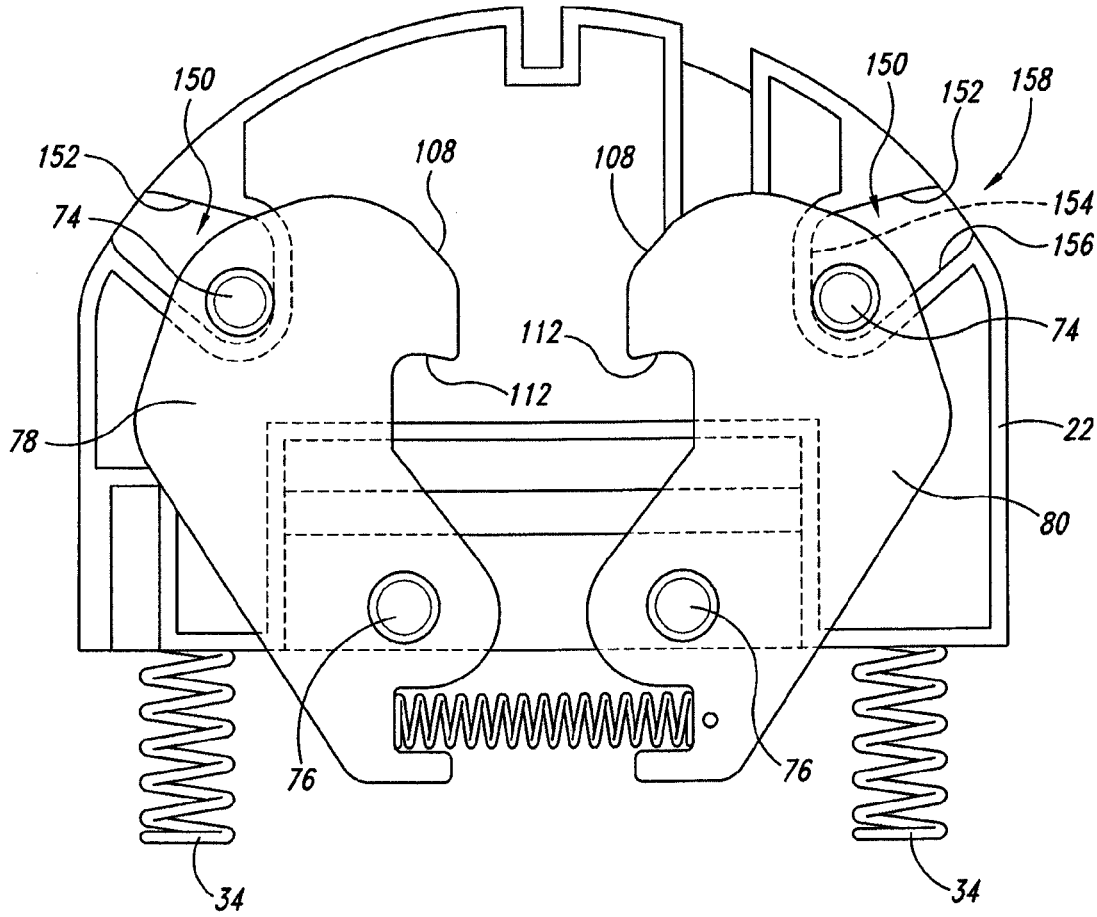
FIG. 6 is a view of the release button and pawl configuration shown in FIG. 4, but with the tongue and frame omitted.

FIG. 6 is a view of the release button 22 and pawl configuration shown in FIG. 5, but with the tongue 12 and frame 40 omitted. The release button 22 is adapted for movement between the upper or locked position shown in FIG. 6 with respect to the hinge pins 76 in a lower or unlocked position. The release button springs 34 urge the release button 22 towards the upper or locked position shown in FIG. 6. The release button 22 includes two recesses 150. Each recess 150 includes an inclined ramp surface 152 and a longitudinally extending delay wall 154 which extends substantially in the direction of a path the release button 22 moves between the locked and unlocked positions. The recesses 150 each include a stop or abutment wall 156 which extends from the delay wall 154 and together with the inclined ramp surface 152 forms a recess opening 158 which opens outwardly from the release button 22. Similar to FIG. 4, the pawls of FIG. 6 are shown in the locking engagement wherein the distal ends of the pawls 78, 80 have rotated about the hinge pins 76 toward one another.

Figure 7:
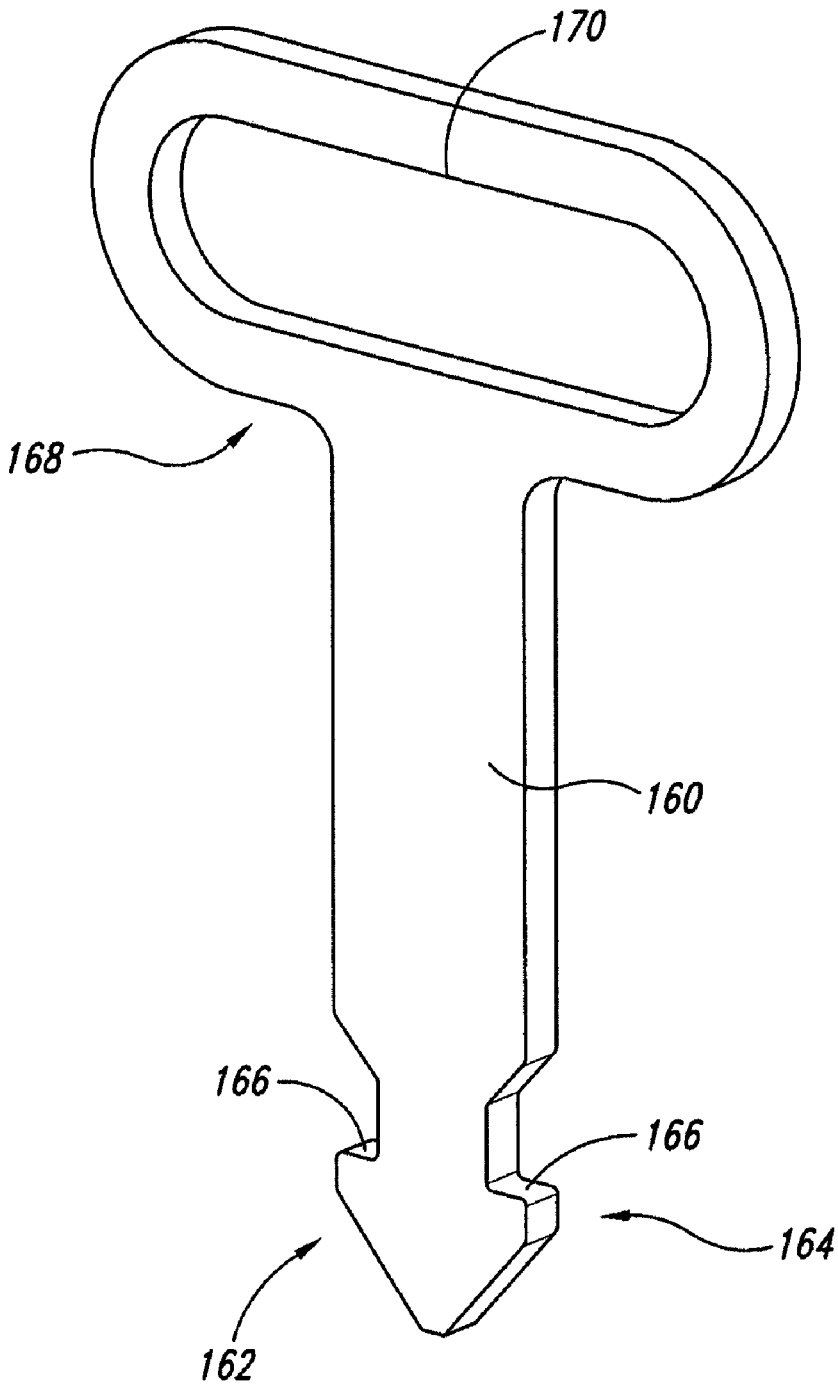
FIG. 7 is a perspective view of a tongue as used in an alternative embodiment of the present invention.

FIG. 7 shows an alternative embodiment of the present invention wherein the dual tongues 26, 28 are replaced by a single tongue 160 configuration. The single tongue 160 of FIG. 7 includes a wedge shaped pawl separator 162 at a distal end 164. Tongue ledges 166 are also provided. The proximal end 168 of the tongue 160 includes a single belt slot 170. However, it will be readily apparent that other configurations are possible for receiving a belt or webbing (not shown). In the alternative embodiment of FIG. 7, the same components as shown in FIG. 4 may be used, including the frame halves 42, 44. However, in the embodiment of FIG. 7, the separator plate 130 is omitted so as to accommodate the single tongue 160.

Figure 8:
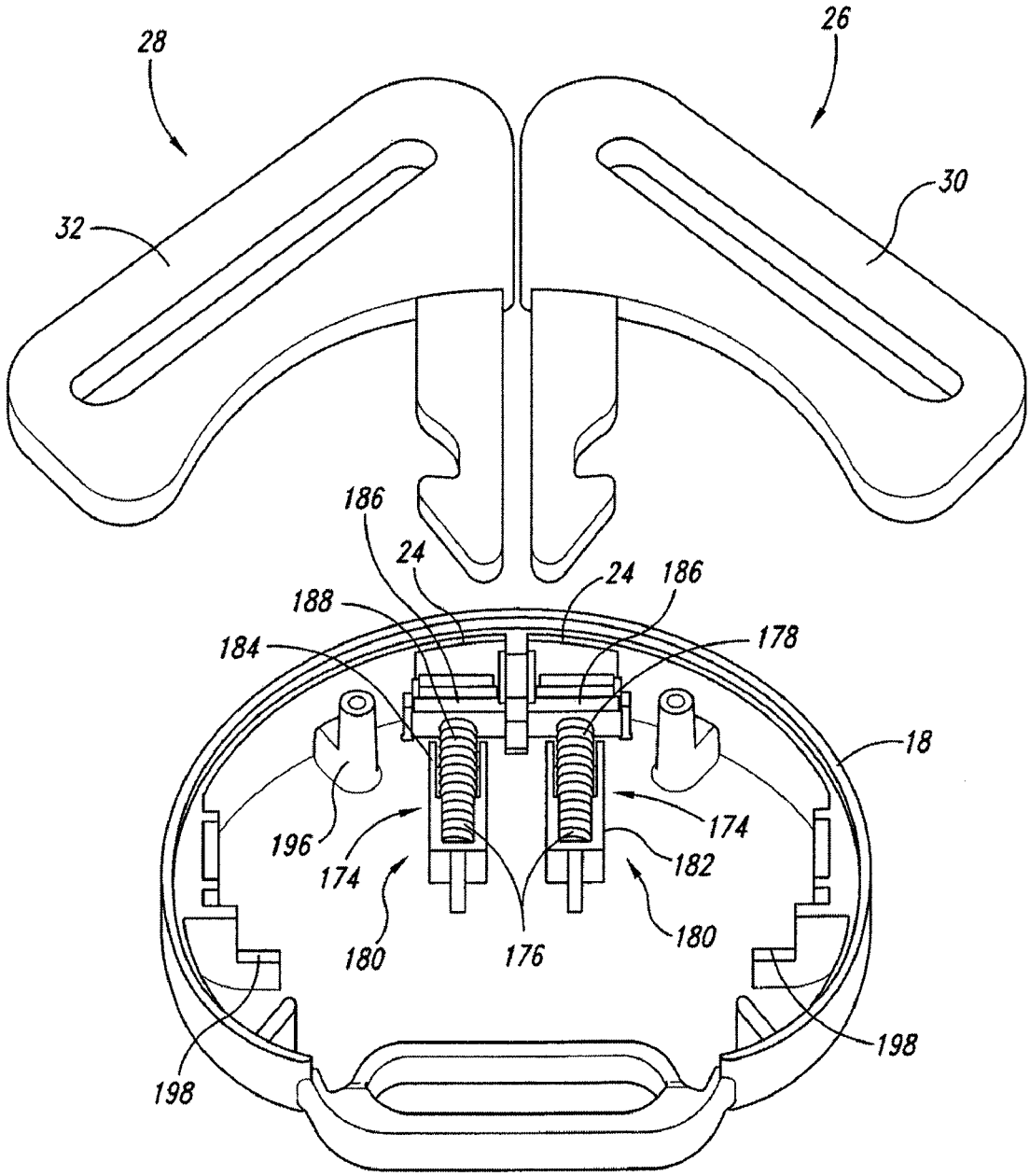
FIG. 8 is a front view of the dual tongue and back housing portion of the housing shown in FIG. 1.
Figure 9:
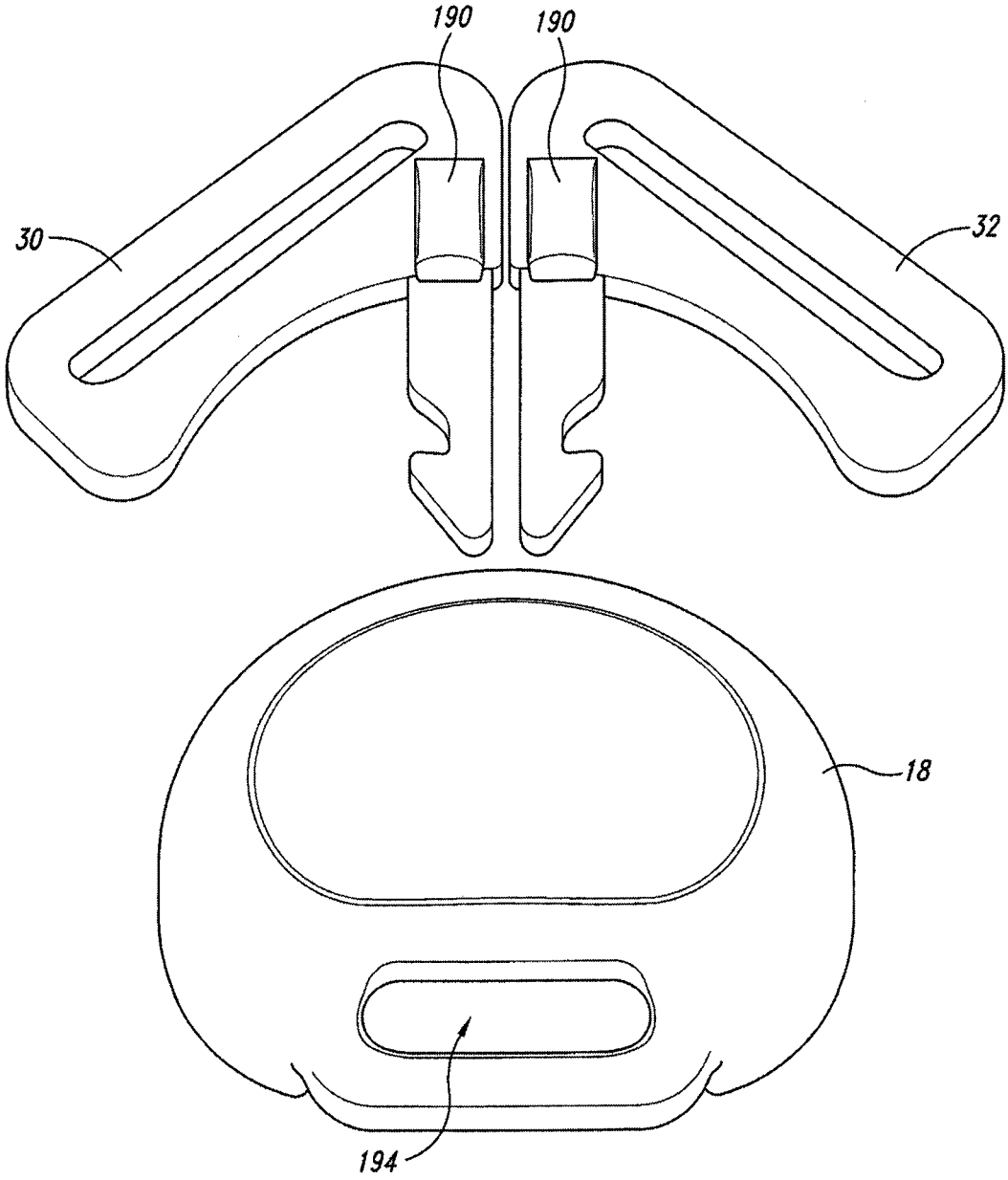
FIG. 9 is a back view of the dual tongue and back housing portion of FIG. 8.

FIG. 8 shows a front view of the back housing portion 18 and the dual tongues 26, 28. The inner face 172 of the back housing portion 18 includes ejector springs 174 having a first end 176 and a second end 178. Ejector guides 180 are provided and include first opposing inner wall faces 182 having a dimension at the first end 176 of the spring 174 which closely conforms to the diameter of the spring 174. The ejector guide 180 further provides second opposing inner wall faces 184 at the second end 178 of the spring 174 which has a greater width than the first inner wall faces 182. The tongue openings 24 are also shown as well adjacent ejector pads or contact surfaces 186. The ejector pads 186 have a stem portion 188 extending into the second end 178 of the respective springs 174. FIG. 9 is a back view of the back housing portion 18 and dual tongue of FIG. 8. FIG. 9 shows the alignment pin 190 which extends from the molded belt slot portion 30, 32 of the respective tongue 26, 28. The alignment pin 190 is arranged as to come into contact with the ejector pad 186. In addition, the alignment pin 190 has a half moon configuration so as to conform with the alignment recess 192 (FIG. 1) which extends from the tongue openings 24. In order for the alignment pin 190 to be inserted into the housing 14, the tongue must be oriented correctly with respect to the housing 14. The back housing portion 18 is shown to include a cut out portion 194 so as to accommodate assembly of a belt (not shown) to the belt slot 46. The inner face of the back housing portion 18 also includes stems 196 for fastening the frame to the housing 14 via the hole 144 located at the neck portion 50. The inner face of the back housing portion 18 also includes raised portions 198 for positioning the frame 40 within the housing 14. The front housing portion 16 has similar configurations so as to maintain the frame 40 within the housing 14.

Figure 10:
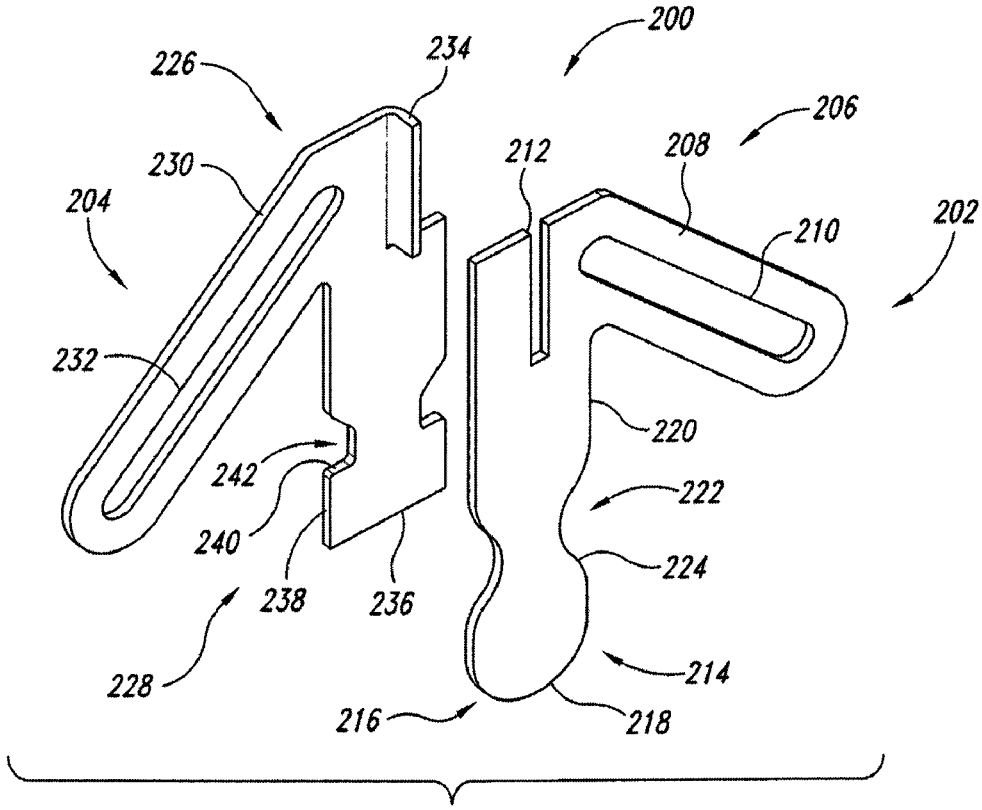
FIG. 10 is a view of an overlapping tongue embodiment in accordance with another embodiment of the present invention.

FIG. 10 is a view of a tongue 200 in accordance with yet a further embodiment of the present invention. FIG. 10 discloses overlapping tongue embodiment and includes a pawl spreader tongue 202 and a pawl lock tongue 204. The pawl spreader tongue 202 includes a proximal end 206 having a depending portion 208 having a belt slot 210. The proximal end 206 further includes a locking slot 212. The distal end 214 of the tongue 202 includes a pawl spreader 216 having an end 218 which is substantially curved. In one alternative embodiment, the pawl spreader 216 may include a distal end 218 which presents a spade like shaped configuration. For example, the pawl separator 216 may include a distal end 218 having a mid section portion (not shown) which is perpendicular to the longitudinal axis of the tongue, and outer edge portions (not shown) on either side of the mid section portion, wherein the outer edge portions converge towards the distal end 218 of the tongue 202. The pawl spreader tongue 202 further includes lateral edges 220, the lateral edges 220 each include a clearance notched area 222. The clearance notched areas 222 present an edge 224 which diverge from one another towards the distal end 214 of the tongue 202.

The pawl locking tongue 204 includes a proximal end 226 and a distal end 228. A depending portion 230 extends from the proximal end 226 and includes a belt slot 232. The proximal end 226 also includes a locking tab 234. The distal end 228 includes a substantially flat edge 236 which extends substantially perpendicular to a longitudinal axis of the tongue 204. The pawl locking tongue 204 further includes lateral edges 238. The lateral edges 238 include tongue ledges 240 which are formed by a notch 242 in the lateral edge 238. The tongue ledges 240 extend substantially in a direction perpendicular to the longitudinal axis of the tongue 204.

Figure 11:
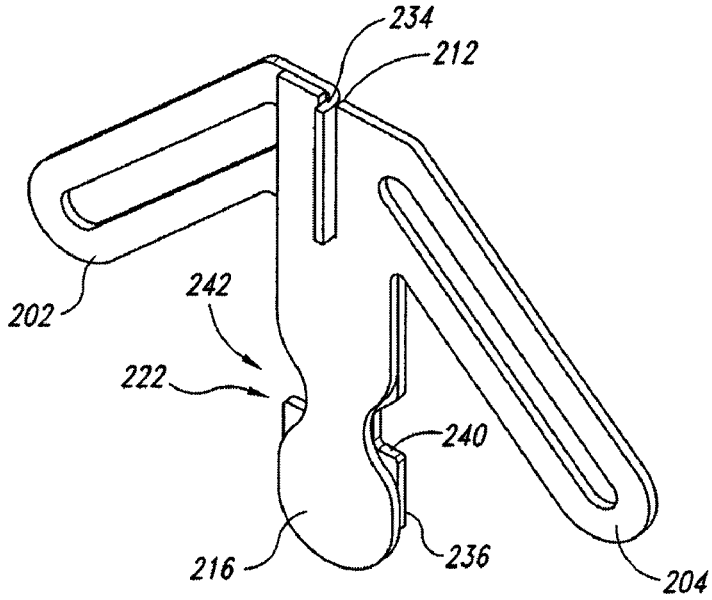
FIG. 11 is a view of the tongue shown in FIG. 10 arranged in overlapping configuration for insertion into a buckle.

FIG. 11 shows the pawl spreader tongue 202 placed over the pawl lock tongue 204 in interlocking engagement via the tab 234 extending through the slot 212. It will be appreciated that the pawl spreader 216 extends beyond the flat edge 236 so that the pawl spreader 216 is presented to the pawls 78, 80 upon insertion of the interlocking tongues 202, 204 into a buckle 10. Further, it can be seen that the clearance notch area 222 of the pawl spreader tongue 202 and the notches 242 of the pawl lock tongue 204 expose the tongue ledges 240 so that the interlocking tongues 202, 204 may be locked with the ledges 112 of the pawls 78, 80. It will be appreciated that the insertion of only the pawl lock tongue 204 into the buckle 10 will cause the flat edge 236 to come into abutment with the distal ends 82 of the pawls 78, 80 and will not spread the pawls 78, 80 due to the flat edge 236 presented to the distal end 82 of the pawls. The pawl spreader tongue 202 is required in order to spread the pawls 78, 80 apart and allow complete entry of the tongue. Similarly, while the pawl spreader 216 may be inserted into the buckle 10 without the pawl lock tongue 204, due to the sloping edges 224 of the pawl spreader 216 which do not present the locking ledges as in the pawl lock tongue 204, the pawl spreader 216 alone is incapable of being locked within the buckle 10. This feature prevents the intervertent securement of a single tongue 202, 204 within a buckle 10.

Figure 12:
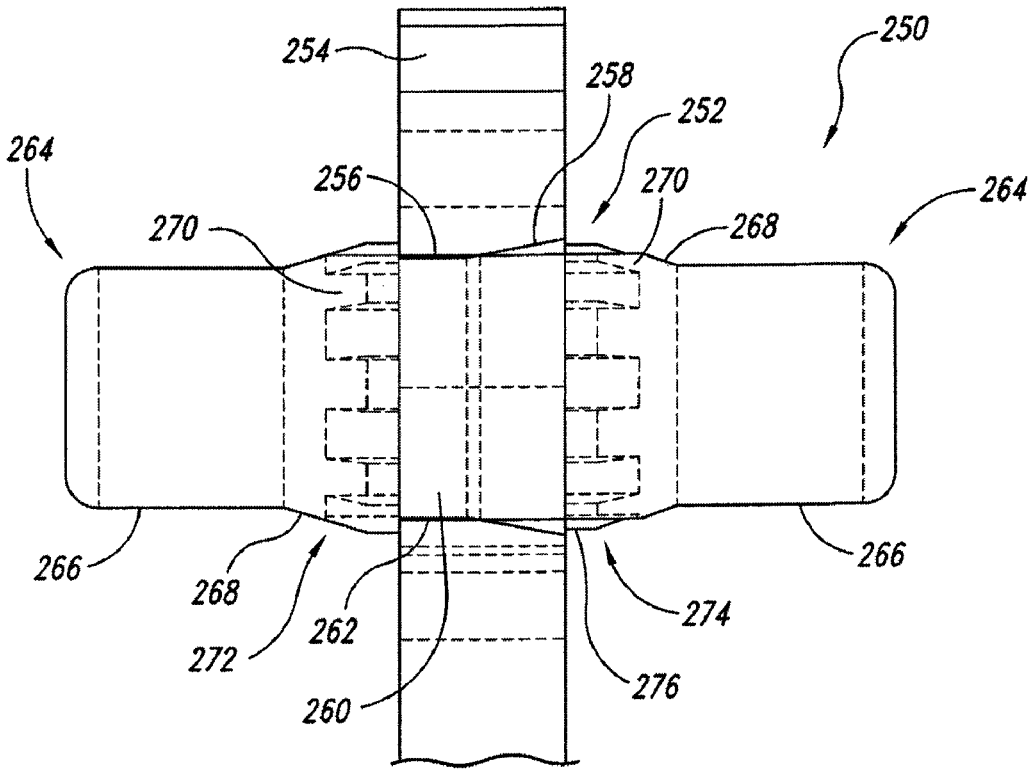
FIGS. 12 and 13 are a partial cross sectional, partial side view of a pawl pin extending through an opening in a pawl, and a perspective view of the pawl, respectively.
Figure 13:
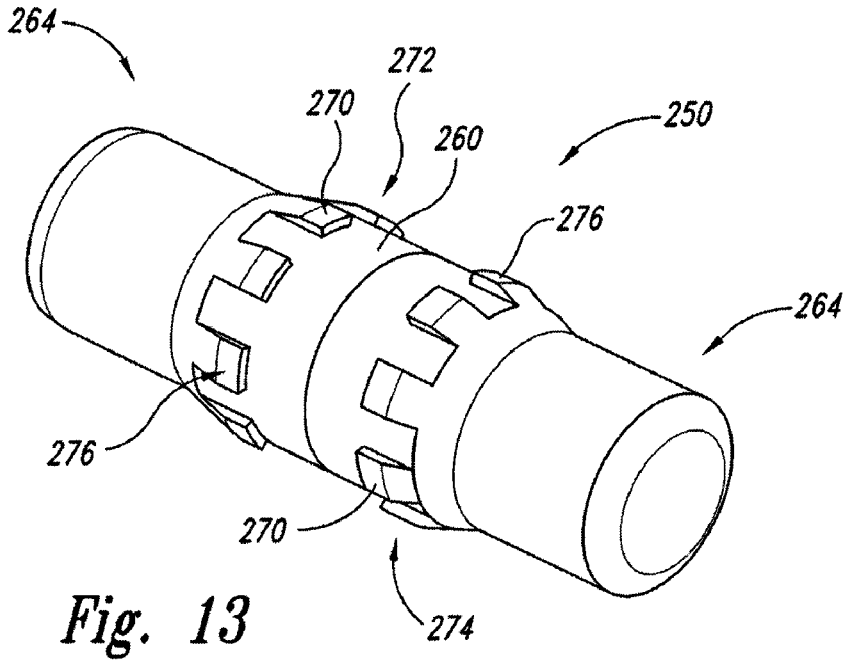

FIG. 12 shows a partial cross sectional partial side view of a pawl pin 250 extending through an opening 252 in a metal part 254, such as a pawl. FIG. 13 is a perspective view of the pawl pin 250. The pawl opening 252 was formed via a stamped process. The desired opening diameter 256 is shown on the left. As an unintended consequence of the stamping process, the diameter of the opening increases towards the right side in a conical fashion to a maximum diameter 258. Insertion into a stamped opening in a pawl or other metal part results in the pin having an interference fit with the opening on the left side but without an interference fit with the opening on the right side in the area of the conical opening. As a result, undue stress may be imposed upon the pin causing flexing and premature breakage of the pin. This is true regardless of whether the pin is made of metal or plastic. However, the plastic pins are more susceptible to premature breakage. The pin 250 of FIG. 12 presents a central tubular portion 260 having a substantially constant diameter which provides an interference fit 262 with the opening. The length of the central tubular portion 260 is longer than the length of the opening 252. End portions 264 provide a diameter which is smaller than the diameter of the opening 252 so as to avoid an interference fit. The end portions 264 include the smaller reduced diameter cylindrical end 266 as well as the tapered or transition portion 268 which extends from the central tubular portion 260. Ribs 270 are located about the central tubular portion 260. The ribs 270 have a length substantially shorter than the length of the portion 260. The ribs 270 extend in a longitudinal direction but arranged about the perimeter of the central tubular portion 260 and adjacent each of the end portions 264, defining first and second rib areas 272, 274. The diameter defined by each of the first and second rib areas 272, 274 is capable of providing an interference fit 276 within the conical shaped open area of the opening. Yet, the ribs 270 may be deformed so as to allow insertion into the opening 252. Upon assembly, FIG. 12 discloses that the central tubular portion 260 provides an interference fit 262. In addition, the ribs of the second rib area provide an interference fit 276.

The operation of the buckle and tongue combination is relatively straightforward. To lock the tongue to the buckle, the user inserts the tongue into the neck portion of the buckle. The tongue will engage the pawls and spread the pawls apart so as to cause the pawls to rotate about the hinge points. The rotation of the pawls will move the release pins in a direction generally outwardly. The release pins will act upon the release button so as to move the release button downwardly with respect to the housing and frame. The downward movement of the release button will load the release button spring. Upon the distal end of the tongue clearing the hook portion of the pawls, the pawls will close upon the tongue with the pawl ledges coming into locking engagement with the tongue ledges. The rotation of the pawls toward the tongue is a result of the pawl spring and release button springs unloading the compressive forces. The release button does not need to be actuated by the user during coupling of the tongue with the buckle. In order to release the tongue from the buckle, the user presses the release button in a downward direction. When the user pushes the release button in the downward direction, the effective spacing between the pawl release pins increases as a result of the ramp surface acting upon the release pins. At the same time, the release button springs and pawl spring are compressed and loaded with a compressive force. As the pawl ledges disengage from the tongue ledges, the compressive load stored in the ejection springs urge the contact pad outwardly from the housing. The contact pad similarly urges the alignment pins and consequently the tongues outwardly from the housing such that they will not reengage with the pawls upon release of the release button. As soon as the tongue clears the hook portion of the pawls, the loaded compressive force of the pawl spring and release button spring will urge the pawls to rotate back to a closed position and urge the release button upward to a locked position. The function of the contact pad is to act as a style feature or protective cover for the internal mechanism. The function of the Ejector Guide is to allow the contact pad to move vertically and remain aligned with the spring and the cover. Without this feature, the user has to use two hands to operate the device. One hand is used to push and hold the Release Button, and the other hand is used to pull the tongues out of the buckle. Users in the market would prefer to only use one hand to release the buckle.

We claim:

1. A restraint buckle assembly comprising:

a frame;

a first pawl pivotally attached to the frame, wherein the first pawl includes a first release member projecting from a first surface of the first pawl;

a second pawl spaced apart from the first pawl and pivotally attached to the frame, wherein the second pawl includes a second release member projecting from a second surface of the second pawl, and wherein the first and second pawls are moveable between locked positions and open positions;

a biasing member operably coupled to the first and second pawls to urge the pawls toward the locked positions; and a release button slidably coupled to the frame and moveable along a path between a first position and a second position, wherein the release button includes a first recess spaced apart from a second recess, wherein the first recess receives the first release member and the second recess receives the second release member, and wherein the release button urges the first and second pawls from the locked positions toward the open positions when the release button is moved from the first position toward the second position.

2. The restraint buckle assembly of claim 1, wherein each release member is a release pin.

3. The restraint buckle assembly of claim 1 wherein the biasing member is a first biasing member, and wherein the restraint buckle assembly further comprises a second biasing member that urges the release button along the path toward the first position.

4. The restraint buckle assembly of claim 3 wherein the first recess includes a first wall portion that contacts the first release member, and the second recess includes a second wall portion that contacts the second release member, when the release button is in the first position.

5. The restraint buckle assembly of claim 1 wherein each of the first and second recesses includes:

a stop wall portion that contacts the corresponding release member to at least partially retain the release button in the first position;

a delay wall portion extending from the stop wall portion in a direction that is at least generally parallel to the path; and a release wall portion extending at an angle from the delay wall portion, wherein the release wall portion engages the respective release member to rotate the first and second pawls outwardly toward the open positions when the release button is moved along the path toward the second position.

6. The restraint buckle assembly of claim 5 wherein:

a first force is required to move the release button along the path when the first and second release members are in contact with the delay wall portions; and a second force, greater than the first force, is required to move the release button along the path when the first and second release members are in contact with the release wall portions.

7. The restraint buckle assembly of claim 1 wherein the frame includes a first slot spaced apart from a second slot, wherein the first release member projects into the first slot and the second release member projects into the second slot.

8. The restraint buckle assembly of claim 1 wherein the frame further comprises a first opening and a second opening spaced apart from the first opening, and wherein the restraint buckle assembly further comprises a first hinge pin positioned in the first opening to pivotally attach the first pawl to the frame, and a second hinge pin positioned in the second opening to pivotally attach the second pawl to the frame.

9. The restraint buckle assembly of claim 1, further comprising:

a first tongue having a first engagement surface that engages a first ledge surface of the first pawl when the first pawl is in the locked position;

a second tongue portion separate from the first tongue portion having a second engagement surface that engages a second ledge surface of the second pawl when the second pawl is in the locked position; and a tongue separator operably coupled to the frame between the first and second tongue portions when the first and second tongue portions are interlocked with the corresponding first and second pawls.

10. The restraint buckle assembly of claim 1, further comprising:

a housing at least partially surrounding the frame and the first and second pawls, wherein the housing includes an alignment opening; and a tongue configured to be removably inserted into the housing through the alignment opening and engaged with the pawls, wherein the tongue includes an alignment member protruding from a front side of the tongue corresponding to the alignment opening.

11. The restraint buckle assembly of claim 10 wherein the biasing member is a first biasing member, and the assembly further comprises:

a second biasing member operatively coupled to the housing; and an ejector member slidably coupled to the housing, wherein the ejector member has a first side spaced apart from a second side, wherein the first side is operably coupled to the second biasing member and the second side contacts the alignment member when the tongue is inserted into the housing at least partially biasing the tongue away from the pawls.

12. A buckle and tongue combination for restraining an occupant in a seat, the buckle and tongue combination comprising:

a housing;

a frame located within the housing;

two pawls disposed upon the frame, each pawl having a distal end and a proximal end, each distal end having a release pin extending from the respective pawl;

a hinge pin disposed at the proximal end of each pawl for pivotally coupling the pawls to the frame;

a tongue adapted to be disposed adjacent the two pawls, wherein the tongue interlockingly engages the pawls;

a biasing member disposed within the housing, wherein the biasing member engages the pawls, urging the pawls to a locked position with respect to the adjacent tongue; and a release button slidably secured along the frame, the release button biased in a first or locked position, the release button having at least one inclined abutment surface which engages the release pins and urges the two pawls towards an unlocked position when the release button is urged toward a second position opposite from the first position, whereby the user is able to release the tongue from the buckle upon depressing the release button toward the second or unlocked position;

wherein the release button is a molded component having two recesses which open outwardly away from the release pins, wherein the inclined abutment surface is a release wall formed in each of the two recesses, wherein the release pins are received by respective button recesses, and wherein the release wall engages the release pins and urges the two pawls towards the unlocked position when the release button is urged toward the second position.

13. The buckle and tongue combination of claim 12, wherein the release wall is spaced apart from the release pins when the pawls are in the locked position, whereby the spaced apart arrangement allows the release button to be moved from the initial locked position up to a point where the release wall comes into contact with the respective release pins, at which time increased force is required to advance the release button so as to disengage the pawls from the tongue.

14. The buckle and tongue combination of claim 12, further comprising a tongue separator, wherein the tongue includes two separate tongues which are adapted to be inserted between the two pawls and on opposite sides of the tongue separator, wherein each pawl has a ledge and each tongue has a ledge, wherein in the locked position each pawl ledge engages the corresponding tongue ledge to secure the respective tongue within the buckle, wherein the proximal ends of the pawls include a spring retainer, and the spring retainers are spaced apart from each other, wherein a pawl spring is located between the spring retainers and urges the pawls into the locked position, wherein the frame further includes arcuate shaped grooves which receive and are arranged in the path of the release pins, the frame also having two deformed tabs which each form a recess to receive the corresponding hinge pin, and wherein the release button is biased toward the first position in part due to the pawl spring and also by first and second release button springs.

15. The buckle and tongue combination of claim 12 wherein the biasing member is a first biasing member, and wherein the buckle and tongue combination further comprises a second biasing member that urges the release button toward the first position.

16. The buckle and tongue combination of claim 12 wherein the tongue includes a belt receiving slot.

17. The buckle and tongue combination of claim 12 wherein the tongue includes two separate tongues configured to be inserted between the two pawls.

18. The buckle and tongue combination of claim 12 wherein the tongue includes two separate tongues configured to be inserted between the two pawls, and wherein each of the two tongues includes a corresponding belt receiving slot.

19. The buckle and tongue combination of claim 12 wherein the frame further includes arcuate shaped grooves which receive the release pins.

20. A retraint buckle assembly comprising:

a frame having a first slot and a second slot;

a first pawl pivotally coupled to the frame, wherein the first pawl includes a first release member projecting from the first pawl, wherein the first release member projects into the first slot;

a second pawl pivotally coupled to the frame, wherein the second pawl includes a second release member projecting from the second pawl, wherein the second release member projects into the second slot, and wherein the first and second pawls are moveable between locked positions and open positions;

a biasing member operably coupled to the first and second pawls, wherein the biasing member urges the first and second pawls toward the locked positions; and a release button moveably coupled to the frame between a first position and a second position, wherein the release button includes a first inclined abutment edge and a second inclined abutment edge, wherein the first release member projects adjacent to the first abutment edge and the second release member projects adjacent to the second abutment edge, and wherein the release button urges the first and second release members outwardly and away from each other when the release button is moved from the first position to the second position.

21. The restraint buckle assembly of claim 20, further comprising:

a housing at least partially surrounding the frame and the first and second pawls; and a tongue configured to be removably inserted into the housing, wherein the tongue includes means for engaging each of the first and second pawls.

22. The restraint buckle assembly of claim 20 wherein the biasing member is a first biasing member, and wherein the restraint buckle assembly further comprises a second biasing member that urges the release button toward the first position.

23. The restraint buckle assembly of claim 20, further comprising:

a housing at least partially surrounding the frame and the first and second pawls; and a tongue configured to be removably inserted into the housing, wherein the tongue includes means for engaging the first pawl.

24. The restraint buckle assembly of claim 20, further comprising:

a housing at least partially surrounding the frame and the first and second pawls;

a first tongue configured to be removably inserted into the housing, wherein the first tongue includes means for engaging the first pawl; and a second tongue configured to be removably inserted into the housing, wherein the second tongue includes means for engaging the second pawl.

* * * * *

UNITED STATES PATENT AND TRADEMARK OFFICE

CERTIFICATE OF CORRECTION

PATENT NO. : 7,520,036 B1
APPLICATION NO. : 10/816013
DATED : April 21, 2009
INVENTOR(S) : Baldwin et al.

It is certified that error appears in the above-identified patent and that said Letters Patent is hereby corrected as shown below:

In column 10, line 28, claim 20, delete “retraint” and insert -- restraint --, therefor.

Signed and Sealed this

Fourteenth Day of July, 2009

John Doll

JOHN DOLL
*Acting Director of the United States Patent and Trademark Office*